United States Patent [19]

Weir et al.

[11] Patent Number: 4,572,596

[45] Date of Patent: Feb. 25, 1986

[54] METHOD AND APPARATUS FOR ASSEMBLING A CABINET FOR AUTOMATIC WASHERS

[75] Inventors: Robert M. Weir, St. Joseph; Dean R. Sommerfeld, Lincoln Township, Berrien County, both of Mich.

[73] Assignee: Whirlpool Corporation, Benton Harbor, Mich.

[21] Appl. No.: 595,526

[22] Filed: Mar. 30, 1984

[51] Int. Cl.[4] ..... A47B 47/05

[52] U.S. Cl. ..... 312/257 R; 312/210; 312/257 SM

[58] Field of Search ..... 312/257, 210, 296, 257 SM, 312/284, 257 A; 220/4 F, 4 R

[56] References Cited

U.S. PATENT DOCUMENTS

| | | | |
|---|---|---|---|
| 1,052,794 | 2/1913 | Brooks | 312/257 R |
| 2,192,862 | 3/1940 | Eagley | 312/257 R |
| 2,230,059 | 1/1941 | Hurley, Jr. et al. . | |
| 2,858,179 | 10/1958 | Puerner et al. | 312/257 |
| 3,284,151 | 11/1964 | Morrison et al. | 220/4 R |
| 3,347,609 | 10/1967 | Mann . | |
| 3,540,614 | 11/1970 | Flagg | 220/4 F |
| 3,575,546 | 4/1971 | Liautaud . | |
| 3,829,186 | 8/1974 | Jonas . | |
| 4,214,797 | 7/1980 | Borresen et al. . | |
| 4,324,035 | 4/1982 | Sherer et al. . | |
| 4,325,594 | 4/1982 | Lang et al. . | |

*Primary Examiner*—William E. Lyddane
*Assistant Examiner*—Joseph Falk
*Attorney, Agent, or Firm*—Hill, Van Santen, Steadman & Simpson

[57] ABSTRACT

A U-shaped cabinet shroud for a front-serviceable appliance is provided with overbent side walls which are forced outwardly by guide pins on a stationary back wall of such appliance as the shroud is positioned onto a base member and the rear wall of the appliance resulting in a tight, secure fit of the shroud to the rear wall.

10 Claims, 9 Drawing Figures

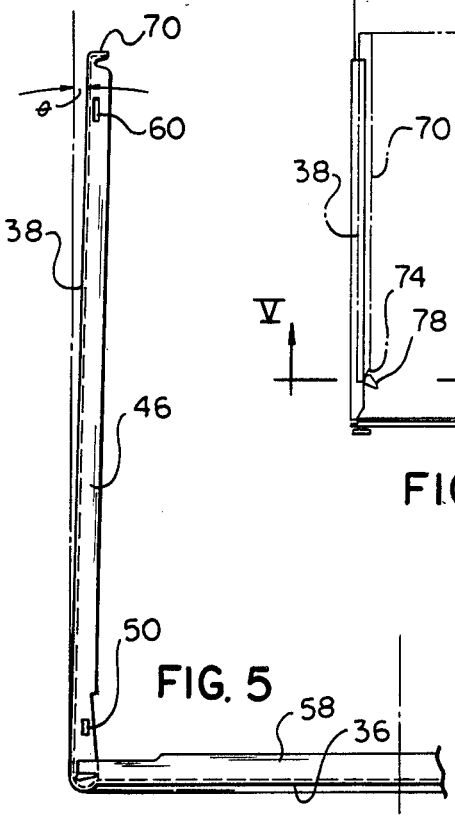
FIG. 5
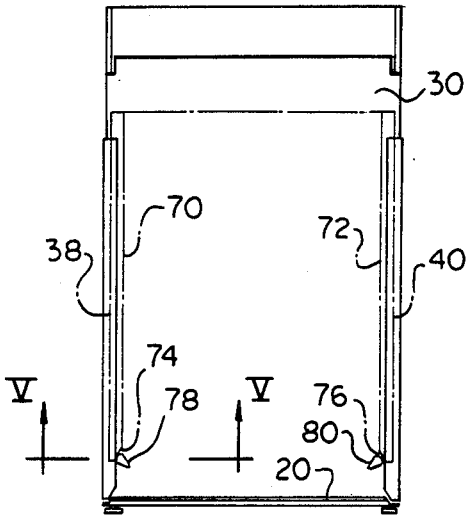
FIG. 4
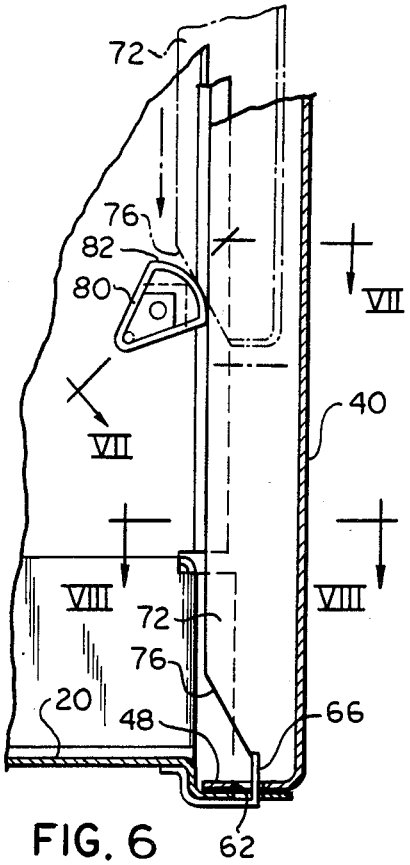
FIG. 6
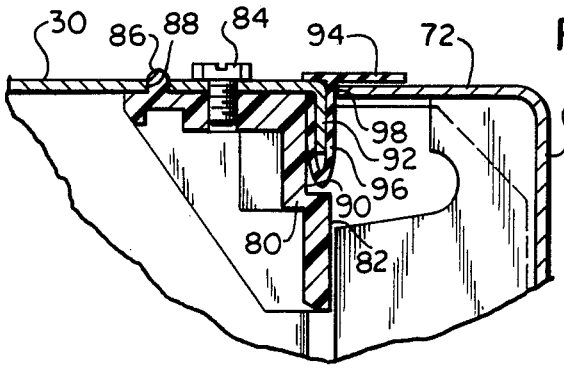
FIG. 7
FIG. 8
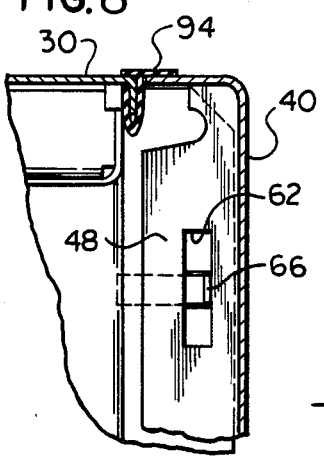
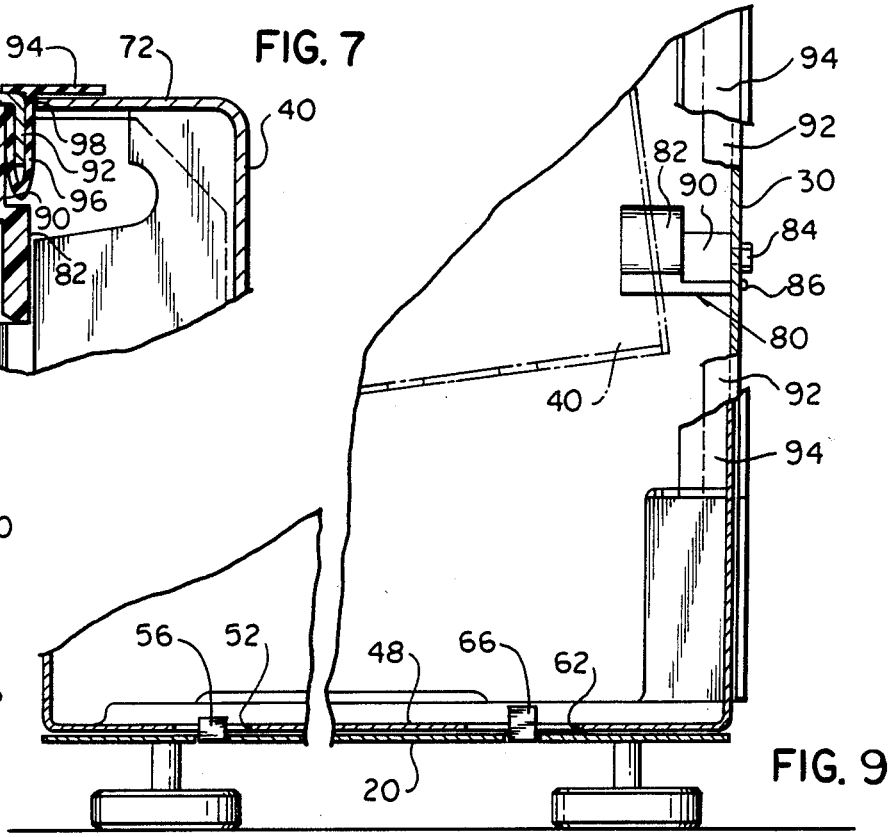
FIG. 9

METHOD AND APPARATUS FOR ASSEMBLING A CABINET FOR AUTOMATIC WASHERS

BACKGROUND OF THE INVENTION

1. Field of the Invention

The present invention relates to cabinets for appliances, and in particular to removable cabinets for front-serviceable appliances and methods of attaching such cabinets.

2. Description of the Prior Art

In U.S. Pat. No. 4,324,035, a method for installing a four-sided cabinet wrapper on an automatic washer is disclosed in FIGS. 10 and 11. The cabinet wrapper is tilted to engage a front flange on the base and rocked rearwardly to engage side tabs and is secured in place by appropriate clips. A problem associated with this method has been the tendency of the U-shaped wrapper to spread apart at the rear, making it difficult to engage the side tabs and leaving the lower rear of the cabinet wider than the top portion which is secured to the top.

U.S. Pat. No. 4,214,797 discloses a case structure having a base member and a C-shaped detachable plastic cover which has a flexible portion near the rear edge portions to flex upon installation for interlocking with the base. U.S. Pat. No. 3,829,186 discloses a method of constructing a container wherein the frame members are flexed for installation of the side panels.

SUMMARY OF THE INVENTION

The present invention provides for a U-shaped cabinet wrapper or shroud which is formed with the opposed sides converging toward the open end of the U rather than being parallel. Thus, the width of the open end is less than the width at the closed front. When the wrapper is placed on the base frame against the back panel, the sides are forced outwardly at the rear to properly fit. In the assembled condition, the sides are thus stressed and an inward force is present keeping them tight against the side flanges of the rear panel.

The front flange of the cabinet is hooked on the base and the cabinet is rocked rearwardly. As the lower rear angled cabinet flanges engage guide pins mounted on the back panel, the sides are forced to their proper spacing so that they fit down properly over the base tabs.

BRIEF DESCRIPTION OF THE DRAWINGS

FIG. 4 is a front view of the rear panel of the cabinet taken along lines IV—IV of FIG. 2 showing the side walls of the shroud fully installed and in broken lines just engaging the back panel guide pins.

FIG. 5 is a sectional view of a side wall of the shroud taken generally along the lines V—V of FIG. 4.

FIG. 6 is an enlarged partial sectional view of the guide pin mounting on the rear wall of the cabinet.

FIG. 7 is a partial side sectional view of the rear panel and guide pin taken generally along the lines VII—VII of FIG. 6.

FIG. 8 is a partial sectional view of the shroud side wall taken generally along the lines VIII—VIII of FIG. 6.

FIG. 9 is a partial side sectional view showing the mounting of the rear panel guide pin.

DESCRIPTION OF THE PREFERRED EMBODIMENTS

Figure 1:
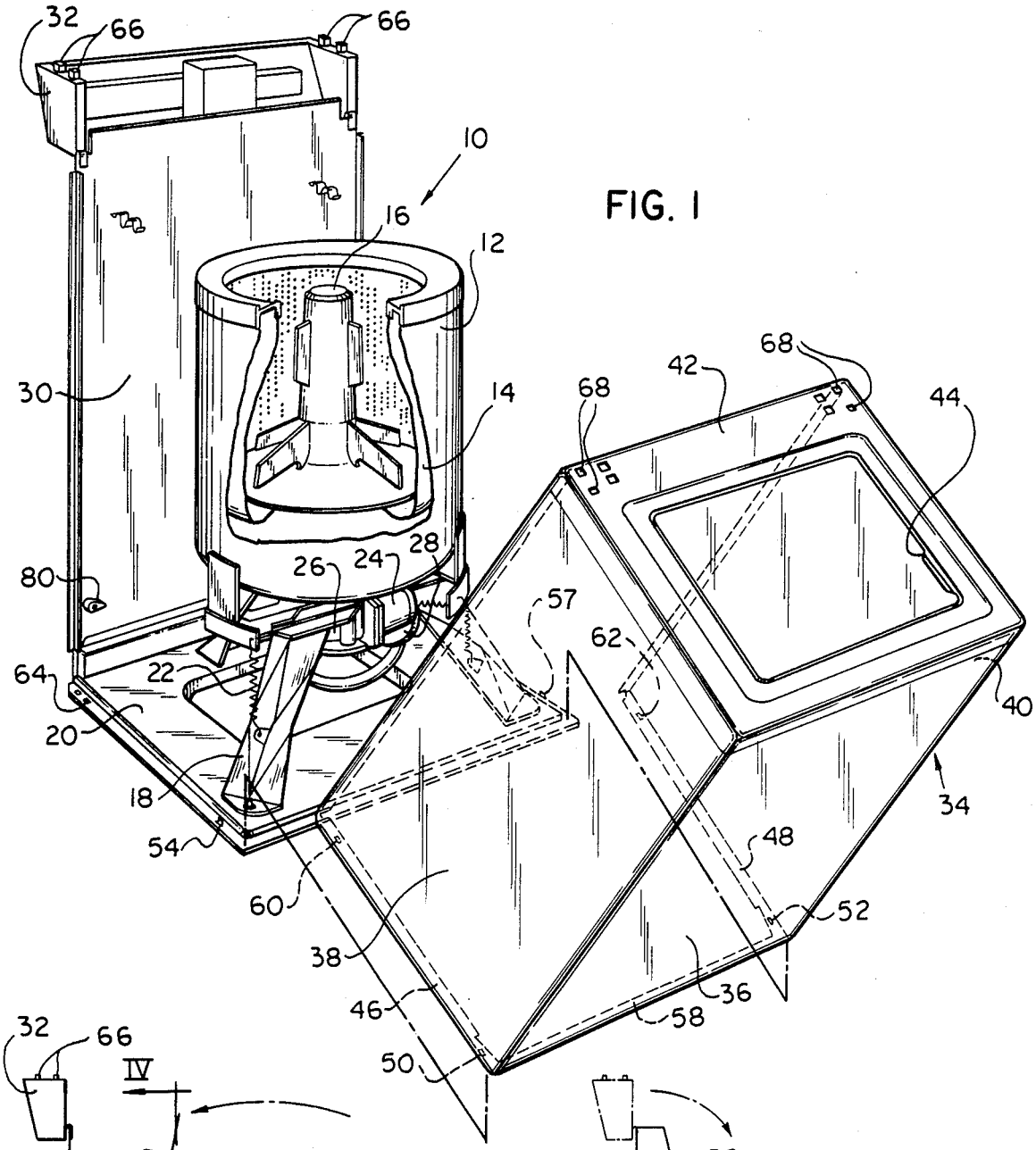
FIG. 1 is a perspective view of an automatic washer embodying the principles of the present invention with the cabinet shroud in a removed position.

In FIG. 1 there is shown a vertical axis automatic washer generally at 10 which includes a wash tub 12, an inner concentric perforate wash basket 14 for carrying a load of clothes and a vertical axis agitator 16. The basket and agitator assembly is carried on a plurality of legs 18 attached to a base panel 20 including suspension means 22. The agitator 16 and basket 14 are driven by an electric motor 24 through a transmission 26. The motor 24 also drives a pump 28. Attached to a rear edge of the base panel 20 is a rear panel 30 to which is hingedly mounted a console 32 containing the appropriate controls for selecting and operating the automatic washer 10 through a series of washing, rinsing and drying steps.

A cabinet shroud shown generally at 34 includes a front panel 36 and connected side panels 38, 40 such that the shroud has generally a U-shape. A top panel 42 is secured to the top portion of the shroud 34 and has an openable lid 44 which permits access into the interior of the wash basket 14 after the cabinet shroud 34 has been assembled as part of the washer 10.

Figure 2:
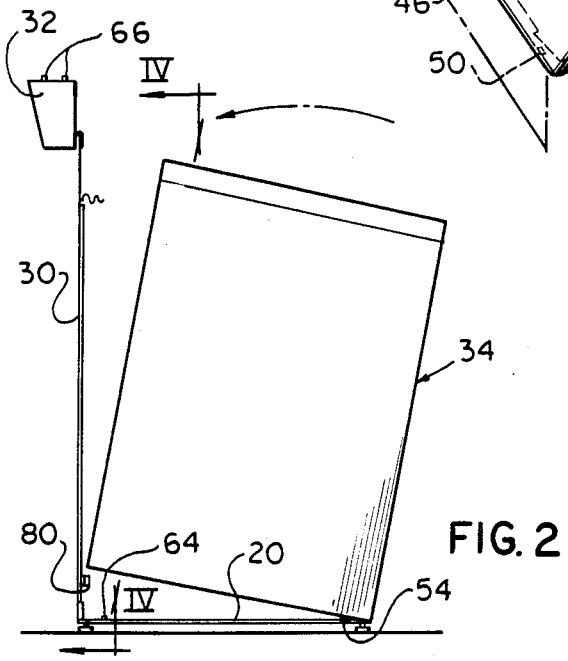
FIG. 2 is a side schematic view illustrating a first step in the installation of the cabinet shroud.
Figure 3:
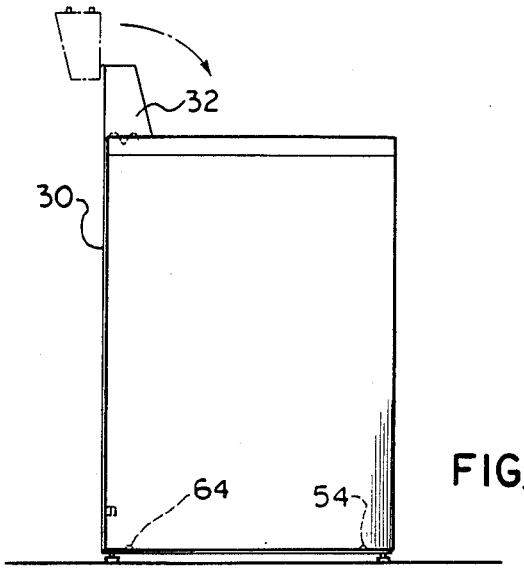
FIG. 3 is a side schematic view illustrating a final step in the assembly of the cabinet.

FIGS. 2 and 3 schematically show the method of assembling the shroud 34 to the base 20 and rear wall 30. As shown in FIG. 1, the side walls 38, 40 of the shroud 34 each have an inwardly extending bottom flange 46, 48, each having an elongated opening 50, 52 near the junction with the front wall 36 which can engage with projections 54, 56 extending upwardly from the base member 20. An inwardly extending bottom flange 58 of the front wall 36 is positioned along a front edge of the base member 20 and the shroud is then pivoted rearwardly on this flange 58 with the projections 54, 56 engaging with the openings 50, 52 until the shroud has been pivoted to its final position in FIG. 3. A second set of openings 60, 62 are provided in the bottom flanges 46, 48 which engage with a second set of projections 64, 66 to hold the rear portion of the side walls 38, 40 in place. Once the shroud is in place, the control console 32 is pivoted about the rear wall 30 to its assembled position such that projections 66 extend into openings 68 in the top wall 42 of the shroud 34. This general construction and method of assembly is shown in U.S. Pat. No. 4,324,035, owned by the assignee of the present invention, the disclosure of which is incorporated herein by reference.

In order to overcome problems associated with prior shrouds, wherein the side walls would only loosely engage the rear wall of the cabinet, the present invention provides for constructing the shroud in an overbent condition such that the side walls 38, 40 extend inwardly a slight degree and are not parallel to each other, resulting in the open end of the side walls being smaller than the width of the front panel 36. As shown in FIGS. 5 and 6, the side walls 38, 40 each have a rear inwardly extending flange 70, 72 respectively, with respective angled bottom edges or ends 74, 76. FIG. 5 also shows the angle $\theta$ which is the angle of overbend formed in the shroud during manufacture.

The angled edges 74, 76 engage with a pair of guide pins 78, 80 secured to the rear wall. The guide pins have a camming surface 82, as best seen in FIG. 6, which engages with the angled edge 76 of the flange 72 causing the side walls 38, 40 to move outwardly to a position flush with the edge of the rear wall 30. FIG. 4 illustrates the overbent condition of side walls 38, 40 showing the relative position (broken lines) of the flanges 70, 72 just before they are separated by the guide pins 78, 80 during installation, and in solid lines the position of the flanges 70, 72 after the shroud is fully installed. In this manner, when the cabinet shroud is fully installed, the side walls are constantly urged towards each other thereby providing a constant and tight fit between the side walls and the rear wall 30.

As seen in FIG. 7, the guide pin 80 is secured to the rear cabinet wall 30 by appropriate fastening means 84 such as a screw. Further, it is prevented from rotating by means of a projection 86 extending through an aligned opening 88 in the rear panel wall 30. The guide 80 extends outwardly away from the rear wall 30 such that the camming surface 82 is spaced from the rear wall 30 by a recessed connecting wall 90. The rear wall 30 has a forwardly extending flange 92 and there is also provided a flexible seal member 94 which is captured on the flange 92, both of which fit into the area adjacent the recessed supporting wall 90. An outer surface 96 of the seal member 94 occupies approximately the same plane as the camming surface 82 such that an end 98 of the flange 72 abuts against the outer surface 96 of the seal member. Another portion of the seal member 94 extends parallel to the rear wall 30 to overlie a portion of the flange 72 to provide a complete seal between the rear wall 30 and the side wall 40. A similar arrangement is provided with respect to the side wall 38 and guide pin 78.

FIGS. 8 and 9 show the opening 62 in the bottom flange 48 of side wall 40 which is elongated to receive the projection 66 as the shroud is pivoted into position. The projection 66 is formed as a separate member attached as by welding to the base 20. As shown in FIG. 6 the projection 66 engages with the bottom flange 48 to hold the shroud against outward movement away from the base.

Thus, it is seen that there is provided a cabinet shroud 34 for an automatic washer 10 in which the shroud is formed in an overbent condition such that the side walls 38, 40 are canted inwardly, and guide pins 80 on the back panel 30 combine with angled flanges 70, 72 on the lower portion of the back edge of the shroud to force the cabinet shroud side outwardly to the proper position as the shroud is installed.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A cabinet construction for a front-serviceable appliance having a rigid base member and a rear wall comprising:

a removable cabinet shroud comprising a front wall with two opposed side walls connected thereto, said side walls being formed at less than 90° to said front wall such that the free rear ends of said side walls are closer together than the width of said front wall, at least one guide pin secured near each lateral side of a lower end of said rear wall, said side walls having inwardly extending flanges with angled bottom edges spaced to engage said guide pins upon assembly of said shroud onto said base member whereby said side walls are forced outwardly as said shroud is moved into position relative to said base member and said rear wall.

2. The device of claim 1 wherein said side walls have bottom flanges with openings therein and said base member has upwardly extending projections wherein said openings receive said projections.

3. The device of claim 1 wherein a single guide pin is secured to said rear wall adjacent each lower side edge of said wall to engage with said side wall flange.

4. The device of claim 2 wherein said bottom flanges have a second opening therein to receive a second set of projections from said base member, one set of projections being positioned near the front of said base member and the other set being positioned near the rear.

5. The device of claim 1 wherein said guide pins have a projecting camming surface for engaging said flanges and a recessed portion for receiving an inwardly extending edge flange of said rear wall.

6. The device of claim 5 wherein a seal member is provided between said rear wall and said side walls which extends into said recessed portion of said guide pins.

7. The device of claim 1 wherein said rear wall has inwardly extending side flanges for engaging with said side wall flanges and said guide pins having camming surfaces coplanar with said rear wall flanges to align said side wall flanges with said rear wall flanges.

8. A method of attaching a cabinet wrapper having two vertical inwardly overbent sides each having a bottom flange with apertures therein and a rear flange with an angled lower end, a front panel having a bottom flange, and a top, to a domestic appliance having a cabinet base frame and having a front edge and having a rear cabinet panel with projecting guide pins adjacent lower side edges of said rear panel spaced to engage said rear flange angled lower ends, said rear panel attached to said base frame and a control housing, said method comprising the steps of:

engaging said bottom flange on said front panel with said front edge of said base frame;

rocking said cabinet wrapper toward said rear panel;

aligning and engaging said angled lower ends of said rear flanges with said guide pins to spread said vertical sides into alignment with said side edges of said rear panel;

securing said cabinet wrapper to said rear panel and to said base frame; and installing said control housing on said cabinet wrapper top.

9. A cabinet comprising:

a base frame;

a vertical rear panel attached to one side of said base frame;

a detachable vertical front wall with attached vertical side walls;

said side walls canted inwardly when said front wall is detached so that the ends attached to said front wall are farther apart than the opposite free ends, said free ends having inwardly directed flanges with angled lower ends, guide pins secured to said rear wall near the lower side edges spaced to engage said angled lower ends of said flanges upon assembly of said cabinet, whereby said side walls are caused to be spread outwardly to align with said side edges of said rear wall.

10. The device of claim 9 wherein said side walls have inwardly directed bottom flanges with apertures therein and said base frame has upwardly directed projections thereon whereby said projections are engaged in said apertures upon assembly of said cabinet.

* * * * *